US008013742B2

(12) United States Patent
Lian et al.

(10) Patent No.: US 8,013,742 B2
(45) Date of Patent: Sep. 6, 2011

(54) METAL OXIDE SEMICONDUCTOR DEVICE FOR USE IN UHF ELECTRONIC ARTICLE SURVEILLANCE SYSTEMS

(75) Inventors: Ming-Ren Lian, Boca Raton, FL (US); Richard Loyd Copeland, Lake Worth, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 504 days.

(21) Appl. No.: 12/331,604

(22) Filed: Dec. 10, 2008

(65) Prior Publication Data

US 2010/0141451 A1 Jun. 10, 2010

(51) Int. Cl.
*G08B 13/14* (2006.01)

(52) U.S. Cl. ..... 340/572.3; 340/572.1; 340/568.1; 340/571

(58) Field of Classification Search ..... 340/572.3, 340/572.1, 568.1, 568.2, 568.8, 571, 572.4, 340/572.7; 235/435, 449, 451, 493
See application file for complete search history.

(56) References Cited

U.S. PATENT DOCUMENTS

| | | | | |
|---|---|---|---|---|
| 4,318,090 | A | 3/1982 | Narlow et al. | |
| 4,574,274 | A | 3/1986 | Pinneo | |
| 5,257,009 | A | 10/1993 | Narlow | |
| 5,608,379 | A | 3/1997 | Narlow et al. | |
| 5,955,951 | A | 9/1999 | Wischerop et al. | |
| 7,152,804 | B1 * | 12/2006 | MacKenzie et al. | 235/492 |
| 7,286,053 | B1 | 10/2007 | Gudeman et al. | |
| 7,750,792 | B2 * | 7/2010 | Smith et al. | 340/10.4 |
| 2005/0179551 | A1 | 8/2005 | Lian et al. | |
| 2005/0183817 | A1 | 8/2005 | Eckstein et al. | |

FOREIGN PATENT DOCUMENTS

| | | | |
|---|---|---|---|
| FR | 2669756 | A1 | 11/1990 |
| WO | 00/16289 | A1 | 3/2000 |

OTHER PUBLICATIONS

International Search Report and Written Opinion dated Mar. 4, 2010 for International Application No. PCT/US2009/005590, International Filing Date Oct. 13, 2009 consisting of 10 pages.
International Search Report and Written Opinion dated Mar. 14, 2006 for International Application No. PCT/US2005/041679, International Filing Date: Nov. 18, 2005 (7-pages).
International Search Report and Written Opinion dated Jun. 15, 2010 for International Application No. PCT/US2010/000801, International Filing Date: Mar. 16, 2010 consisting of 8-pages.

* cited by examiner

*Primary Examiner* — Toan N Pham
(74) *Attorney, Agent, or Firm* — Alan M. Weisberg; Christopher & Weisberg, P.A.

(57) ABSTRACT

An Electronic Article Surveillance ("EAS") tag and method and system for deactivating EAS tags without the need to physically contact the tag with a deactivation device. The EAS tag replaces the conventional diode with a non-linear device such as a metal-oxide-semiconductor ("MOS") capacitor with a given breakdown voltage threshold. Inducing a predetermined voltage across the MOS capacitor results in destruction of the MOS capacitor rendering the EAS tag undetectable in the EAS interrogation system.

20 Claims, 5 Drawing Sheets

METAL OXIDE SEMICONDUCTOR DEVICE FOR USE IN UHF ELECTRONIC ARTICLE SURVEILLANCE SYSTEMS

CROSS-REFERENCE TO RELATED APPLICATION n/a

STATEMENT REGARDING FEDERALLY SPONSORED RESEARCH OR DEVELOPMENT n/a

FIELD OF THE INVENTION

The present invention relates generally to article interrogation systems and more specifically to a method and system for deactivating a tag in an Ultra High Frequency ("UHF") interrogation system without the need to physically contact the tag with a deactivation device.

BACKGROUND OF THE INVENTION

Mixing labels or mixing tags are used in Ultra High Frequency ("UHF") electronic article surveillance ("EAS") interrogation systems and are based on a frequency mixing principle. Typically, mixing tags include a diode attached to a dipole antenna. The tag is tuned at a specific microwave frequency ($f_{uhf}$), such as for example 915 MHz. The frequency range can be chosen from hundreds of Megahertz up to several Gigahertz by adjusting the antenna's dipole length and the diode's junction capacitance. The lower the operating microwave frequency, the longer the dipole length is required, and the larger the capacitance.

However, there are inherent limitations with deactivation devices when having to deactivate tags having diodes. For example, U.S. Pat. Nos. 4,318,090 and 4,574,274 provide UHF mixing tags that use diode non-linear elements and means for direct contact or non-direct contact but with limited range. The breakdown characteristics of the diode requires that a substantial current be driven through diode in order to achieve deactivation, thus resulting in the direct contact with the tag in order to supply sufficient electrical energy to the diode to cause it to be destroyed, thus deactivating the tag. This results in an impractical deactivation system since it is not always possible or economically feasible to be limited to this type of "contact" deactivation. Thus, tag designs of this type are ineffective in situations where deactivation of the tag takes place from a distance, i.e., where the deactivation device is not in contact with the tag. Other prior art deactivation systems (such as the system disclosed in U.S. Pat. No. 5,608,379) have attempted to avoid this problem by adding switches and other hardware devices to the deactivation system. This proves to be costly and cumbersome and results in relatively low deactivation distances for a considerably large magnetic field source.

Neither of the aforementioned attempted solutions solves the problem of how to effectively deactivate EAS tags at a substantial distance without the need for the deactivation device to be in direct contact with the EAS tag and without the need to provide additional deactivation elements to the EAS tag. The inherent characteristics of diodes with their predictable non-linear behavior render EAS deactivation systems that utilize these types of EAS tags ineffective when it comes to deactivating tags from a distance.

Therefore, what is needed is a new EAS tag using a non-linear element that exhibits very low level breakdown characteristics so that reliable deactivation at a considerable distance is achieved.

SUMMARY OF THE INVENTION

The present invention advantageously provides a system, method and apparatus for facilitating the deactivation of tags in UHF interrogation systems by incorporating a non-linear MOS device, such as a MOS capacitor, in the tag. In one aspect of the invention, an electronic article surveillance ("EAS") tag is provided, where the tag includes an antenna circuit, and a non-linear component electrically coupled to the antenna circuit. The non-linear component exhibits non-linear capacitance with respect to voltage below a breakdown voltage threshold and exhibits an irreversible linear capacitance with respect to voltage above the breakdown voltage threshold.

In another aspect, an electronic article surveillance ("EAS") tag deactivation system is provided and includes an EAS tag, where the tag includes an antenna circuit, and a non-linear component electrically coupled to the antenna circuit. The non-linear component exhibits a non-linear capacitance with respect to voltage below a breakdown voltage threshold and exhibits an irreversible linear capacitance with respect to voltage above the breakdown voltage threshold. The system further includes a deactivation device adapted to deactivate the EAS tag without making contact with it.

In yet another aspect of the invention, a method of deactivating an electronic article surveillance ("EAS") tag is provided. The method includes providing an EAS tag having an antenna circuit and a non-linear component electrically coupled to the antenna circuit, where the non-linear component exhibits a non-linear capacitance with respect to voltage below a breakdown voltage threshold and exhibits an irreversible linear capacitance with respect to voltage above the breakdown voltage threshold. The method further includes inducing a voltage across the non-linear component, where the induced voltage is greater than the breakdown threshold in order to break down the non-linear component.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
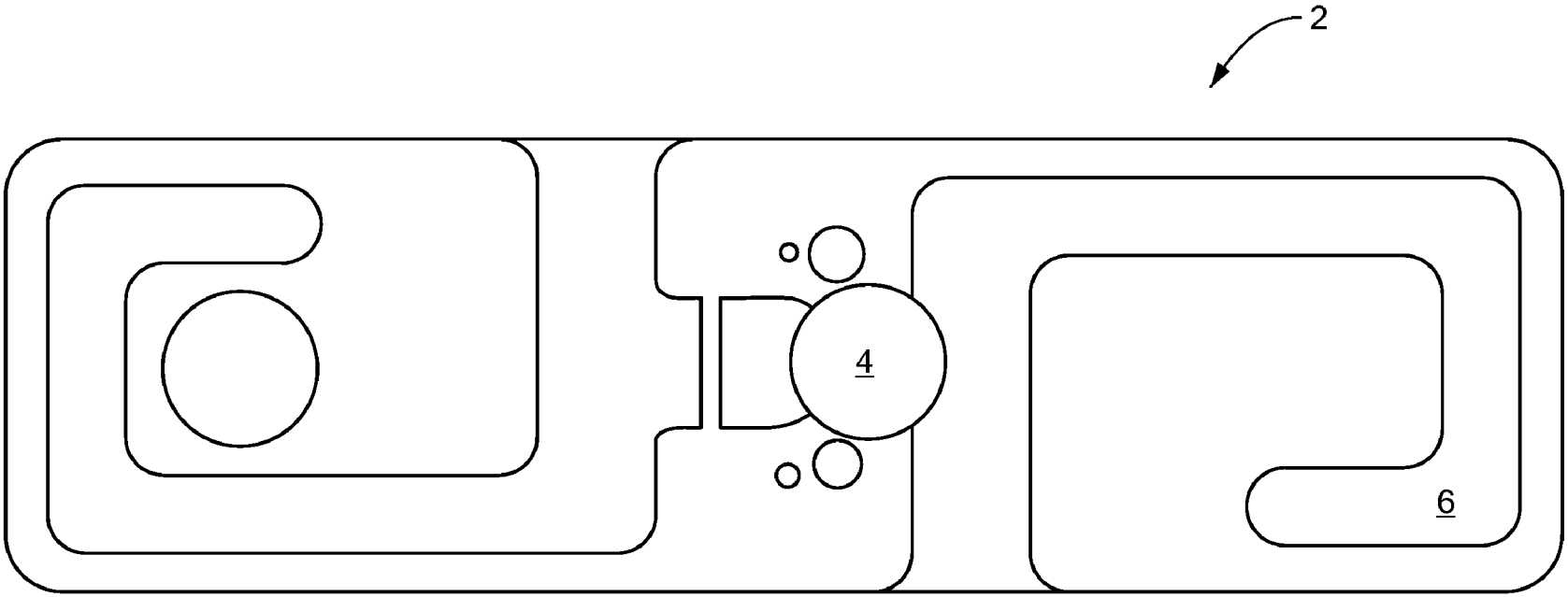
FIG. 1 PRIOR ART
FIG. 1 is a layout of a UHF mixing tag illustrating a prior art tag design utilizing a diode and a dipole antenna.

Before describing in detail exemplary embodiments that are in accordance with the present invention, it is noted that the embodiments reside primarily in combinations of apparatus components and processing steps related to implementing a system, device and method for facilitating the deactivation of EAS tags in a proximity deactivation environment by including within the tag, a nonlinear MOS device that is suitable for breakdown with a low voltage. Accordingly, the system and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements.

FIG. 1 illustrates a prior art design of a mixing marker 2 or mixing tag often used in electronic article surveillance ("EAS") systems. Mixing markers of this type are inherently deficient in tag deactivation systems due to the amount of energy needed to destroy the diode, which is typically designed to be robust and rectify and control voltages. The nonlinearity of the intrinsic capacitance and relatively low voltage breakdown characteristics of the MOS capacitor are more desirable than the diode in this aspect. In FIG. 1, the diode 4 appears between two parts of the antenna 6. Tag designs of this type are ineffective in situations where deactivation of the tag takes place from a distance, i.e., where the deactivation device is not in contact with the tag.

Figure 2:
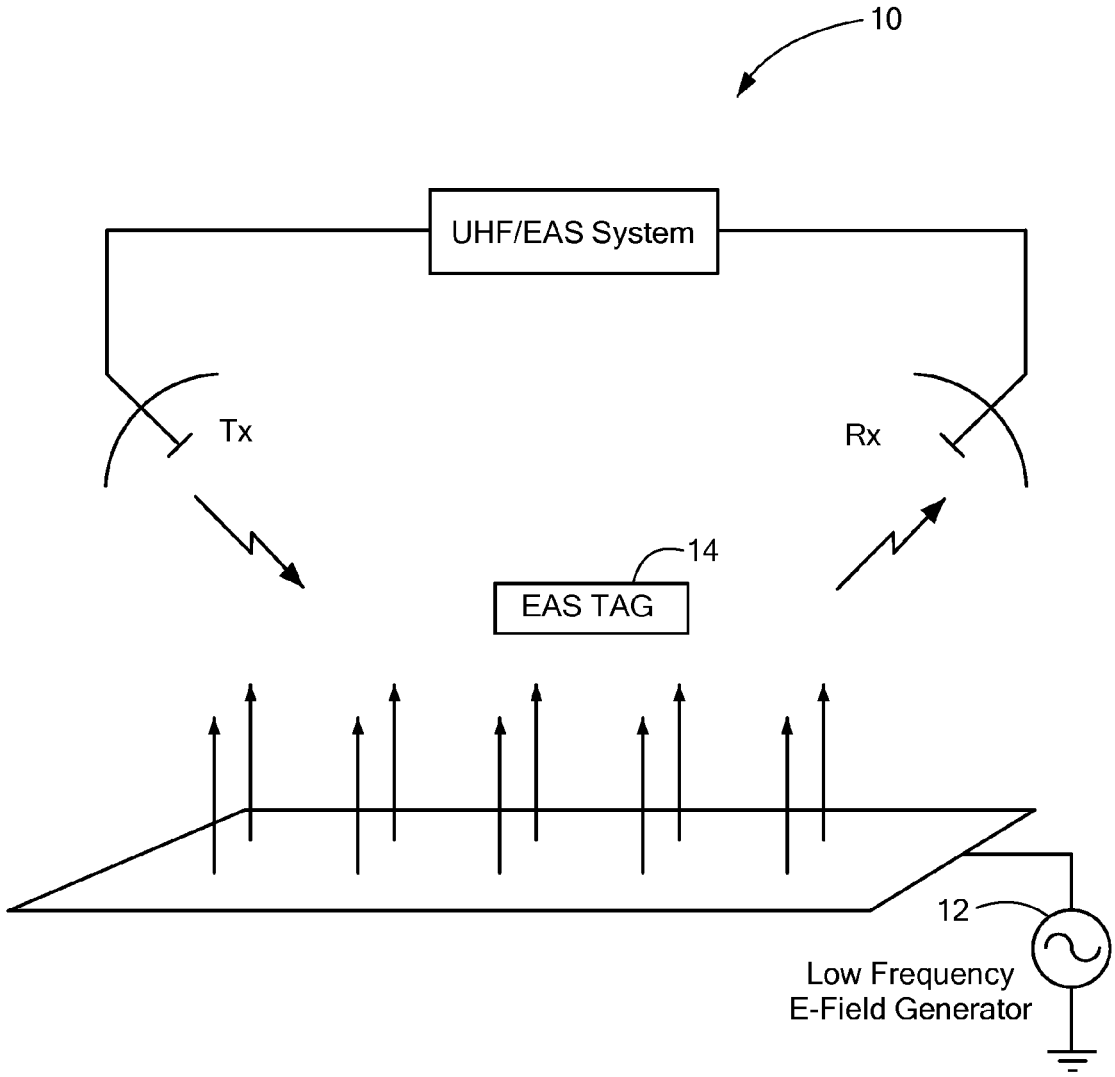
FIG. 2 is a diagram of a UHF mixing EAS system that incorporates the principles of the present invention.

Referring now to the drawing figures in which like reference designators refer to like elements there is shown in FIG. 2 an EAS interrogation system constructed in accordance with the principles of the present invention and designated generally as "10". FIG. 2 illustrates an Ultra High Frequency ("UHF") EAS system used in connection with the present invention. In this system, in addition to a UHF carrier electromagnetic field, a low frequency ($f_{lf}$) field (such as an electric or magnetic field) is also required. Low frequency ("LF") E-field Generator 12 provides the low frequency energy to mixing tag 14. The UHF electromagnetic signal is used along with the LF modulation signal to provide the field sources 12 for the mixing tag 14. Tag 14 includes a non-linear element (discussed in greater detail below) and a dipole antenna. Since the tag's diode junction capacitance varies as a function of voltage, the tag 14 will generate a inter-modulated component ($f_{uhf} \pm f_{lf}$) once it is under the illumination of both UHF and low LF energies. Such an inter-modulated component is received and processed to determine the presence of an EAS device.

Figure 3:
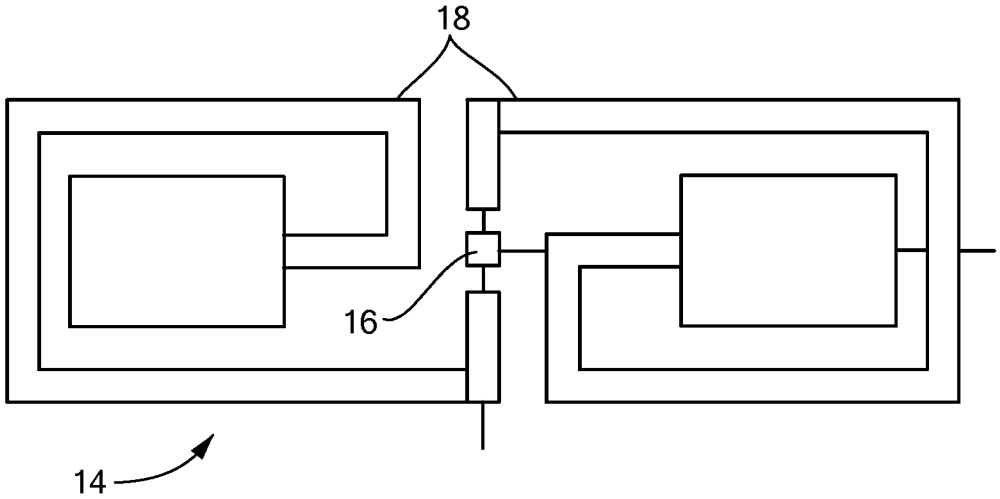
FIG. 3 is a diagram of an EAS tag design utilizing a non-linear MOS element and dipole antenna constructed in accordance with the principles of the present invention.

FIG. 3 illustrates the layout design of mixing tag 14 of the present invention. The present invention provides the capability of deactivating EAS tag 14 without the need for the EAS tag deactivator to be in contact with tag 14. As can be seen in FIG. 3, tag 14 includes a non-linear element such as a Metal Oxide Semiconductor ("MOS") device 16 with an inherent low breakdown voltage, and a dipole antenna 18. In one embodiment, MOS device 16 is situated between each side of dipole antenna 18 and is in electrical contact therewith. The low threshold breakdown voltage of MOS device 16 allows easier deactivation including remote deactivation and does not add additional deactivation elements to EAS tag 14. In addition, the inherent non-linearity of such a MOS device 16 can be higher than a conventional diode, thus providing improved detection performance.

The antenna 18 is tuned approximately to the UHF electromagnetic signal (e.g., 915 MHz). The LF modulation frequency may be, for example, 111 KHz. The LF electric field modulates the non-linear capacitance of the MOS device 16 and creates a series of mixing signals centered about the UHF signal with frequency periodicity of $f_1 \pm N*f_2$, where $f_1$ is the UHF signal frequency, $f_2$ is the LF modulation signal frequency, and N is the sideband number. The mixing signal level is a function of the UHF resonant field, the LF modulation field, the mixing tag antenna 18, and the non-linearity characteristics of the MOS device 16. The MOS device 16 characteristics that affect this mixing signal are discussed below. The detection system consists of UHF and modulation antennas along with electronics that provide the field sources and detection circuitry.

Figure 4:
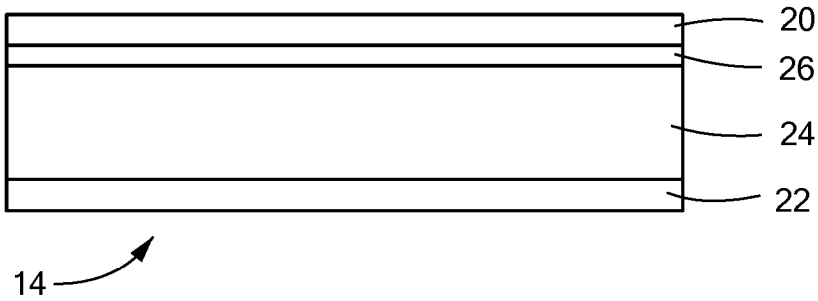
FIG. 4 is a side view a non-linear MOS capacitor used with an EAS tag and constructed in accordance with the principles of the present invention.

Thus, EAS tags having a non-linear diode element such as in the prior art are replaced by EAS tags of the present invention using MOS device 16. FIG. 4 illustrates the components of mixed EAS tag 14. The design depicted in FIG. 4 is one embodiment, and it is within the scope of the invention to modify this design such that it is suitable and compatible with the existing fabrication techniques. Tag 14 includes a top electrode layer 20, a bottom electrode layer 22, a semiconductor region 24 and an insulation layer 26. Due to the insulated layer 26 within the structure, the device behaves like a capacitor.

Figure 5:
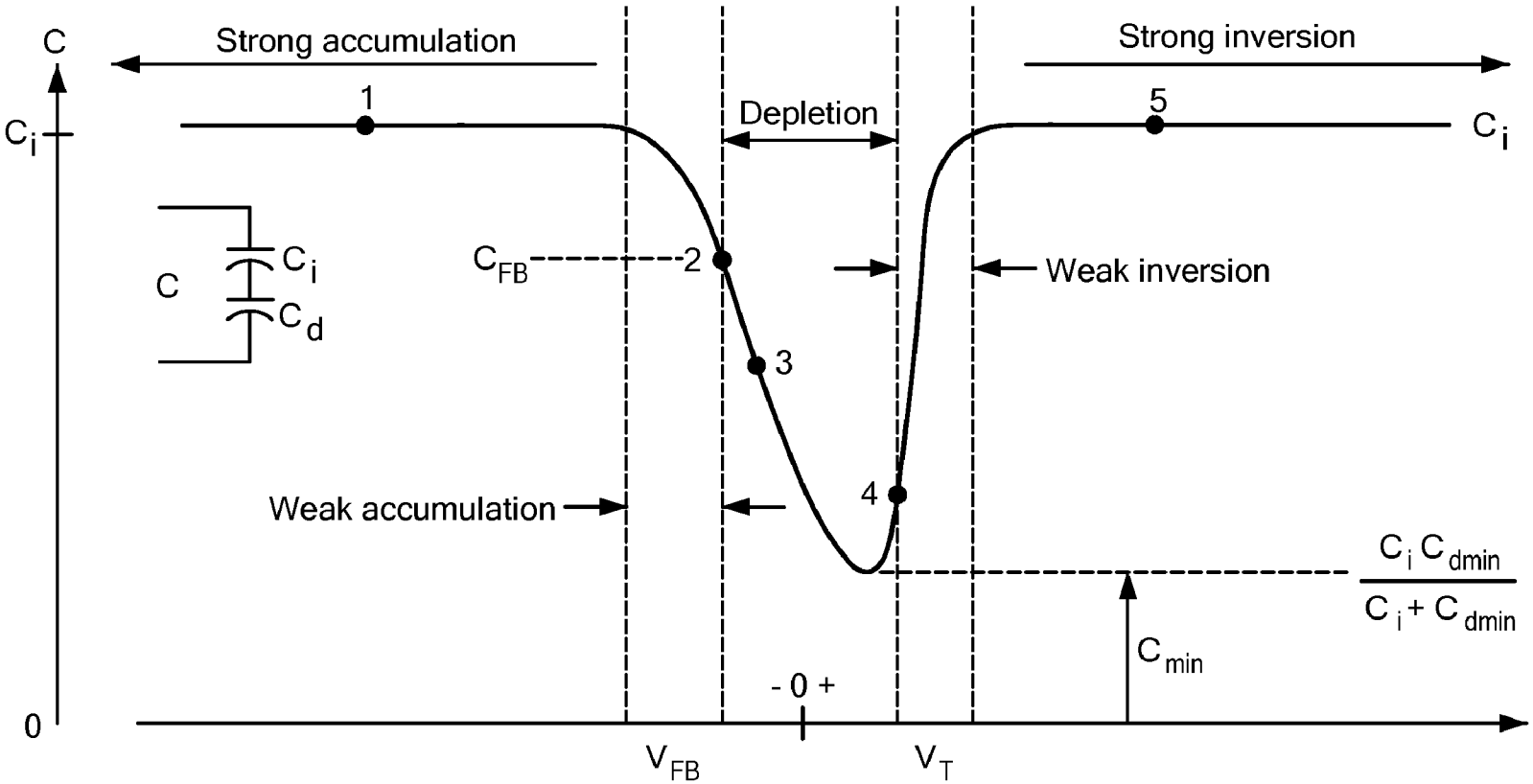
FIG. 5 is a graph illustrating the non-linear capacitance characteristics of a p-type MOS capacitor constructed in accordance with the principles of the present invention.

FIG. 5 shows the C-V (capacitor vs. voltage) characteristics of a device 14 constructed in accordance with the principles of the present invention. As the terminal voltage (also known as gate voltage $V_G$, in this case) increases, an additional space charge region is created. This is equivalent of a second capacitor in series connection with the basic intrinsic capacitor ($C_i$). The maximum junction capacitor for this device is $C_i$, which assumes the values of a capacitor with the thin insulator 26 between the electrodes and can be expressed as below where $\epsilon$, A, d represent dielectric constant of the insulator, area and the thickness of the capacitor where $$C = \varepsilon \frac{A}{d}.$$

With a p-type semiconductor, as the gate voltage increases from negative to positive voltage the holes are pushed away from insulator/semiconductor interface, leaving a bulk of immobile negative ions. This effectively increases the gap, and therefore the total net capacitance is reduced. The capacitance eventually reaches a minimum. Additionally increasing the voltage will not increase the size of the depletion region. A further increase in gate voltage will create an inversion, where a large population of electrons will be attracted to the interface, as a result, the effective capacitance will revert back to the $C_i$ value. This however, will only take place at a low frequency (<100 Hz) region. In a typical high frequency condition, the net capacitance will be measured to be $C_{min}$, as indicated in FIG. 5 since the charge can not respond quickly with the AC field, which is related to the generation-recombination rate of the minority carrier in the inversion layer.

The CV characteristic of MOS device 16 depends on the doping concentration of the semiconductor, thickness of the insulator 26, and the types of materials used for electrodes 20 and 22. The design of the present invention can be altered such that the degree of non-linearity can exceed that of a diode (as used in the prior art) thus further enhancing the UHF EAS system performance. Further, MOS device 16 can be deactivated at distances from the deactivator beyond those EAS devices that use diodes. This arrangement is advantageous when using disposable EAS tags 14. Contrary to a diode, the MOS device 16 can be destroyed by applying a high enough voltage ($V_G$) across the electrodes. The capacitance vs. voltage is non-linear below the threshold voltage, but beyond the threshold breakdown voltage the device irreversibly operates as a linear capacitor, thus permanently eliminating any mixing signal. As a result, the EAS function can be effectively eliminated and/or altered resulting in the ceased production of the mixing signal. i.e., deactivation occurs. With the relatively low breakdown voltage of MOS device 16 it is possible to create a deactivation distance without adding additional features to the non-linear element (i.e., MOS device 16) of EAS mixing tag 14.

To facilitate the ease of deactivation, the breakdown voltage of MOS device 16 of EAS tag 14 can be further minimized. This can be achieved by, for example, reducing the thickness of insulation/dielectric layer 26. With a thinner layer, a high E-field can be generated to induce breakdown. Alternately, it is possible to choose different kinds of insulators having lower breakdown voltages. In yet another embodiment, impurity or defect centers may be included during the deposition of the dielectric layers to encourage the breakdown.

Thus, MOS device 16 has a built-in breakdown voltage characteristic that determines the deactivation characteristics in mixing tag 14. A deactivator device provides an E-field source within regulatory limits at a determined operating frequency. The E-field couples to the mixing tag 14 to provide the necessary breakdown of the thin oxide layer of the MOS device 16. Below this breakdown threshold, MOS device 16 operates as a non-linear capacitor. However, after breakdown is achieved, MOS device 16 operates irreversibly as a linear capacitor with a somewhat lower capacitance value. Absence of the non-linearity characteristic renders mixing tag 14 undetectable in an EAS mixing system.

Figure 6:
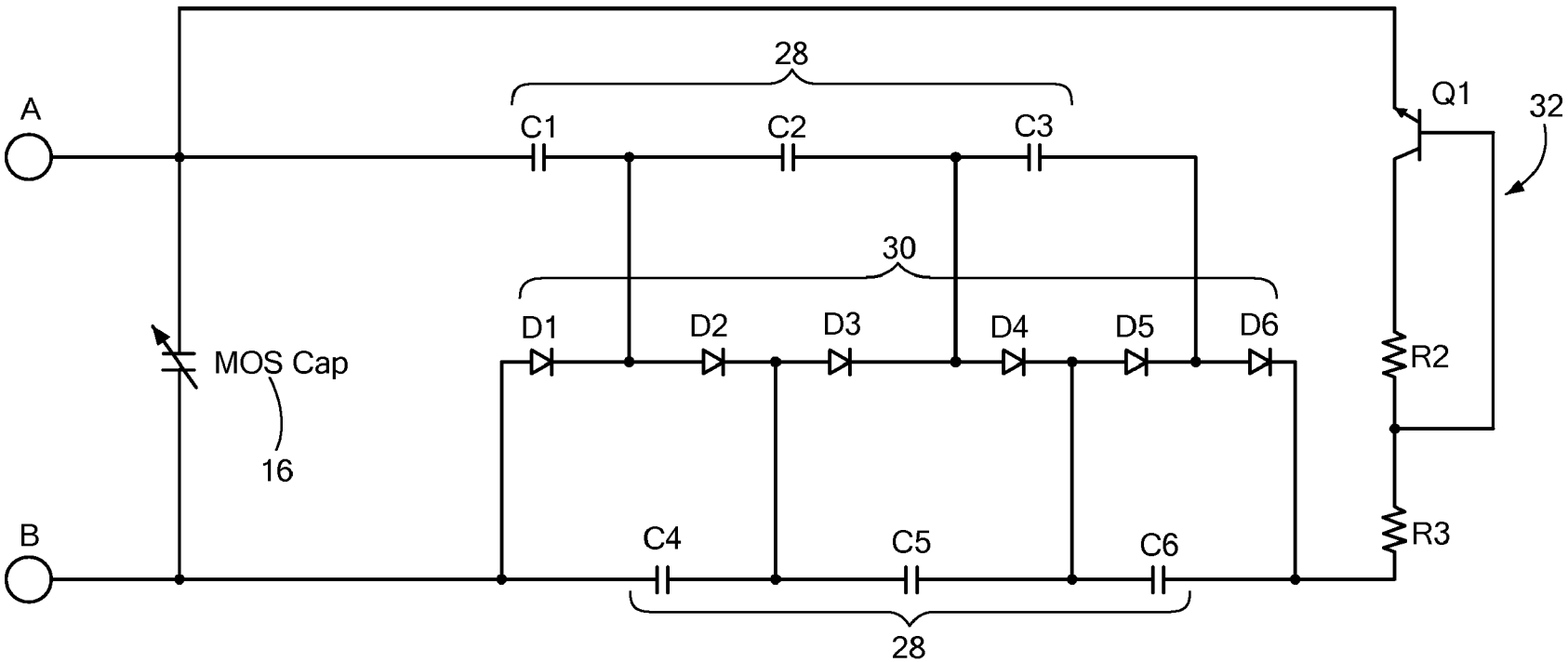
FIG. 6 is a circuit diagram used to enhance the deactivation characteristics of the EAS tag constructed in accordance with the principles of the present invention.

FIG. 6 illustrates an alternate embodiment of the present invention. In this embodiment, a step-up voltage circuit is added in order to amplify the deactivation field-induced voltage across the MOS device 16 in order to enhance deactivation performance. In this scenario, certain electronic components can be added along with the MOS device 16. As previously described, an antenna, such as a dipole or loop antenna, is attached to points A and B to connect with the nonlinear MOS capacitor device 16. In the exemplary embodiment of FIG. 6, a Cockroft Walton voltage multiplier is used to raise the DC voltage up to several fold of $V_{in}$ peak voltage. It is noted that other types of step-up circuits that serve to increase the voltage across MOS device 16 may also be used. In this example, a ladder network of capacitors 28 (C1-C6) and diodes 30 (D1-D6) serve to amplify the voltage across MOS device 16. The voltage output of the final stage is then fed back to the MOS device 16 through a MOSFET switch 32. As the voltage increased to a predetermined amount, the MOSFET switch 32 is switched on, and a high voltage is available to the destruction of the MOS device 16. Other circuits may be incorporated in order to improve deactivation performance by stepping up the voltage across MOS device 16.

Thus, antenna 18 is electrically connected to points A and B, and MOS device 16 can include the circuit depicted in FIG. 6, which enhances the deactivation performance by stepping up the applied voltage when a sufficient deactivation E field is applied to the antenna 18. Under normal detection mode, the step-up voltage circuit appears as an open circuit as the passive diode and transistor devices are below the required range of turn-on needed to activate the step-up voltage circuit.

The present invention advantageously provides and defines a device, system and method used to facilitate the deactivation of EAS tags in a proximity deactivation environment by including within the tag, a nonlinear MOS device that is suitable for breakdown with a low voltage.

In addition, unless mention was made above to the contrary, it should be noted that all of the accompanying drawings are not to scale. Significantly, this invention can be embodied in other specific forms without departing from the spirit or essential attributes thereof, and accordingly, reference should be had to the following claims, rather than to the foregoing specification, as indicating the scope of the invention.

What is claimed is:

1. An electronic article surveillance ("EAS") tag comprising:

an antenna circuit; and a non-linear component electrically coupled to the antenna circuit, the non-linear component exhibiting a non-linear capacitance with respect to voltage below a breakdown voltage threshold and exhibiting irreversible linear capacitance with respect to voltage above the breakdown voltage threshold.

2. The electronic article surveillance ("EAS") tag of claim 1, wherein the non-linear component is a metal-oxide-semiconductor ("MOS") device.

3. The electronic article surveillance ("EAS") tag of claim 2, wherein application of a predetermined voltage to the MOS device results in destruction of the MOS device, thereby rendering the EAS tag undetectable by an EAS interrogation system.

4. The electronic article surveillance ("EAS") tag of claim 3, wherein the MOS device includes an insulator layer, wherein application of the predetermined voltage to the MOS device results in electrical breakdown of the insulation layer.

5. The electronic article surveillance ("EAS") tag of claim 3, further comprising a step-up circuit electrically coupled to the MOS device, the step-up circuit increasing the voltage applied to the MOS device.

6. The electronic article surveillance ("EAS") tag of claim 5, wherein the step-up circuit includes a switch that is activated at a predetermined voltage, making the increased voltage available to the MOS device.

7. The electronic article surveillance ("EAS") tag of claim 1, wherein the antenna circuit includes a dipole antenna.

8. The electronic article surveillance ("EAS") tag of claim 1, wherein the antenna circuit includes a first portion and a second portion, and the non-linear component being located between the first portion of the antenna circuit and the second portion of the antenna circuit.

9. The electronic article surveillance ("EAS") tag of claim 1, wherein the EAS tag is a mixing tag modulated by a combination of high frequency and low frequency signals.

10. An electronic article surveillance ("EAS") tag deactivation system comprising:

an EAS tag, the tag comprising:

an antenna circuit; and a non-linear component electrically coupled to the antenna circuit, the non-linear component exhibiting a non-linear capacitance with respect to voltage below a breakdown voltage threshold and exhibiting irreversible linear capacitance with respect to voltage above the breakdown voltage threshold; and a deactivation device adapted to deactivate the EAS tag without making contact with it.

11. The system of claim 10, wherein the non-linear component is a metal-oxide-semiconductor ("MOS") device.

12. The system of claim 11, wherein the deactivation device applies a predetermined voltage across the MOS resulting in destruction of the MOS device, thereby rendering the EAS tag undetectable by an EAS interrogation system.

13. The system of claim 12, wherein the MOS device includes an insulator layer, wherein application of the predetermined voltage to the MOS device results in breakdown of the insulation layer.

14. The system of claim 12, further comprising a step-up circuit electrically coupled to the MOS device, the step-up circuit increasing the voltage applied the MOS device.

15. The system of claim 14, wherein the step-up circuit includes a switch that is activated at a predetermined voltage, making the increased voltage available to the MOS device.

16. The system of claim 10, wherein the antenna circuit includes a dipole antenna.

17. The system of claim 10, wherein the antenna circuit includes a first portion and a second portion, and the non-linear component being located between the first portion of the antenna circuit and the second portion of the antenna circuit.

18. The system of claim 10, wherein the EAS tag is a mixing tag modulated by a combination of high frequency and low frequency signals.

19. A method of deactivating an electronic article surveillance ("EAS") tag, the method comprising:

providing an EAS tag having an antenna circuit and a non-linear component electrically coupled to the antenna circuit, the non-linear component exhibiting a non-linear capacitance with respect to voltage below a breakdown voltage threshold and exhibiting irreversible linear capacitance with respect to voltage above the breakdown voltage threshold; and inducing a voltage across the non-linear component, the induced voltage being greater than the breakdown threshold in order to breakdown the non-linear component.

20. The method of claim 19, wherein the non-linear component is a metal-oxide-semiconductor ("MOS") device.

* * * * *